US011015371B2

(12) United States Patent
Schmidt et al.

(10) Patent No.: US 11,015,371 B2
(45) Date of Patent: May 25, 2021

(54) METHOD FOR ACTUATING A DOOR LOCK, AND DOOR LOCK

(71) Applicant: EBE Elektro-Bau-Elemente GmbH, Leinfelden-Echterdingen (DE)

(72) Inventors: Nikolaus Schmidt, Sindelfingen (DE); Vadim Navalov, Stuttgart (DE); Marc Guthoerl, Stuttgart (DE)

(73) Assignee: EBE Elektro-Bau-Elemente GmbH, Leinfelden-Echterdingen (DE)

( * ) Notice: Subject to any disclaimer, the term of this patent is extended or adjusted under 35 U.S.C. 154(b) by 628 days.

(21) Appl. No.: 15/837,354

(22) Filed: Dec. 11, 2017

(65) Prior Publication Data

US 2018/0163433 A1 Jun. 14, 2018

(30) Foreign Application Priority Data

Dec. 14, 2016 (EP) ..... 16204036

(51) Int. Cl.
*E05B 15/04* (2006.01)
*E05C 3/12* (2006.01)
(Continued)

(52) U.S. Cl.
CPC ..... *E05B 63/22* (2013.01); *A47L 15/4259* (2013.01); *E05B 15/04* (2013.01); *E05B 17/0025* (2013.01); *E05B 17/0029* (2013.01); *E05B 17/0037* (2013.01); *E05B 47/0004* (2013.01); *E05C 3/12* (2013.01);
(Continued)

(58) Field of Classification Search
CPC ..... E05B 63/22; E05B 15/04; E05B 17/0025; E05B 17/0029; E05B 17/0037; Y10S 292/21; Y10S 292/42; Y10S 292/61; Y10S 292/69; Y10S 292/71; Y10T 292/1051;
(Continued)

(56) References Cited

U.S. PATENT DOCUMENTS 959,241 A * 5/1910 Mallory ..... E05B 47/0002 292/71
1,090,305 A * 3/1914 Hoffman ..... E05B 65/0864 70/100
(Continued)

FOREIGN PATENT DOCUMENTS

DE 195 40 843 A1 5/1997
DE 198 37 248 A1 2/2000
(Continued)

OTHER PUBLICATIONS

Extended European Search Report dated May 26, 2017 for corresponding European Application No. EP 16 20 4036.

*Primary Examiner* — Carlos Lugo
(74) *Attorney, Agent, or Firm* — Renner, Otto, Boisselle & Sklar, LLP

(57) ABSTRACT

In order to lock the door proceeding from the open position, a locking bar is brought into the locked position under tension of a spring element, in which locked position a closing force acting on the locking bar is determined by the spring element, and, in order to unlock the door, the locking bar is brought out of the locked position into an unlocked position with the aid of an actuating force that is not applied by the spring element, and, after the striker has moved out of the locked position, the locking bar moves into the open position by the force of the spring element.

15 Claims, 16 Drawing Sheets

(51) Int. Cl.

| | |
|---|---|
| ***E05B 63/22*** | (2006.01) |
| ***E05B 47/00*** | (2006.01) |
| ***A47L 15/42*** | (2006.01) |
| ***E05C 19/02*** | (2006.01) |
| ***E05B 17/00*** | (2006.01) |
| ***E05C 3/22*** | (2006.01) |
| *E05B 53/00* | (2006.01) |
| *E05C 5/00* | (2006.01) |

(52) U.S. Cl.
CPC ..... *E05C 3/22* (2013.01); *E05C 19/02* (2013.01); *E05B 53/006* (2013.01); *E05C 2005/005* (2013.01); *E05Y 2900/304* (2013.01); *Y10S 292/69* (2013.01); *Y10T 292/1057* (2015.04)

(58) Field of Classification Search
CPC ..... Y10T 292/1057; Y10T 292/1061; Y10T 292/1083; E05C 3/12; E05C 3/22
See application file for complete search history.

(56) References Cited

U.S. PATENT DOCUMENTS 1,269,467 A * 6/1918 Leonard ..... E05B 85/243 292/216
1,302,168 A * 4/1919 Hugues ..... E05B 83/243 292/129
1,396,163 A * 11/1921 Cleal ..... E05B 65/0811 70/98
2,129,926 A * 9/1938 Geske ..... E05B 65/0042 292/332
2,341,416 A * 2/1944 Anderson ..... E05B 65/0042 292/335
2,348,955 A * 5/1944 Buchanan ..... E05B 65/0042 292/255
2,359,150 A * 9/1944 Peglow ..... E05B 65/0042 292/336
2,679,428 A * 5/1954 Rop ..... E05B 65/0046 292/332
2,698,197 A * 12/1954 Jacobson ..... E05B 63/20 292/336
2,833,578 A * 5/1958 Burke ..... E05C 19/024 292/71
3,041,098 A * 6/1962 Johnson ..... E05C 19/024 292/78
3,968,984 A * 7/1976 Guth ..... A47L 15/4259 292/229
4,210,349 A 7/1980 Cook et al.
5,518,282 A * 5/1996 Sawada ..... E05B 17/2011 292/252
5,595,409 A * 1/1997 Fier ..... E05B 17/042 292/112
6,733,051 B1 * 5/2004 Cowper ..... E05B 63/242 292/192
7,210,711 B2 * 5/2007 Dirnberger ..... A47L 15/4259 292/223
7,255,375 B2 * 8/2007 Heid ..... E05B 15/0006 292/112
7,347,460 B2 * 3/2008 Ala ..... A47L 15/4259 292/216
8,276,951 B2 * 10/2012 Dirnberger ..... E05C 3/24 292/336
9,267,315 B2 * 2/2016 Lee ..... E05C 19/024

FOREIGN PATENT DOCUMENTS

DE 19944050 A1 * 3/2001 ..... E05B 63/0052
DE 10350710 A1 * 5/2005 ..... D06F 37/42
EP 0 727 178 A2 8/1996
FR 2749343 A1 * 12/1997 ..... E05B 17/0037
GB 395910 A * 7/1933 ..... E05B 63/242

* cited by examiner

METHOD FOR ACTUATING A DOOR LOCK, AND DOOR LOCK

CROSS-REFERENCE TO RELATED APPLICATIONS

This application claims priority under 35 USC § 119 to European Application No. 16 204 036.4, filed on Dec. 14, 2016, the entire disclosure of which is incorporated herein by reference.

TECHNICAL FIELD

The present disclosure relates to a method for actuating a door lock comprising a lock mechanism in a door lock housing for a door of an electrical domestic appliance, preferably a dishwasher, wherein a locking bar is moved from an open position into a locked position by means of a spring element for locking, wherein, in the open position, the door is opened and the locking bar is disengaged from a latch of a striker disposed on the domestic appliance and, in the locked position, the door is closed, the striker is in a locked position in the door lock housing, and the locking bar is engaged with the latch. The disclosure also relates to a door lock for an electrical domestic appliance, comprising a door lock housing, which can be disposed in the door of the domestic appliance and which has an opening for a striker, which can be fastened on the domestic appliance, a locking bar disposed in the door lock housing for engagement into a latch in the striker in a locked position, in which the striker is in a locked position, wherein the locking bar has a contact surface and is connected to a lever element, which is mounted so as to be rotatable about an axle, and a spring element, which is disposed between the lever element and an abutment.

DESCRIPTION OF THE RELATED ART

In the case of electrical domestic appliances designed in the manner of a dishwasher, the door lock can be installed into the door as well as into the housing of the device. Located on the other one of these two parts is a striker, which, during the closing of the door, is introduced into the lock and hooks into position there. The present disclosure relates to the cases in which the door lock is disposed in the door.

The fronts of the domestic appliances can comprise a handle for opening the door, in the traditional manner, or, in the case of handle-free fronts, can be opened by means of appropriate actuating mechanisms, which are triggered either automatically by the machine or by the operator. In door locks used to date, the closing spring is usually loaded during the opening of the door, in order to thus build up the closing force for the closed state, DE 198 37 248 A1 describes a door lock of the type described at the outset, wherein the closing spring is tensioned in an open position of the door lock. The door lock comprises a frame having an opening for a striker and a closing member, such as a closing lever, in the frame. Moreover, a closing spring is provided, which is disposed between the closing member and an abutment in the frame, wherein the closing member is connected to a gripping device. In the open position of the door lock, the gripping device is pressed against a part of the frame or in the frame at a contact point by the closing spring and, in this way, release of the spring is prevented. The gripping device has a gripping latch, into which the striker can be introduced through the opening in the frame, and which has a contact surface, against which the incoming striker presses and thus causes a movement of the gripping device. The gripping device is shaped in such a way that, during a movement of the hook, the gripping device loses contact with the contact point and, as a result, the closing spring can release.

It is disadvantageous that the spring for closing must be preloaded by the operator during opening. As a result, an automatic opening of the door, in particular in the case of handle-free doors, is possible only by means of additional, complex devices, for example a motor. The motor is required in order to open the door and preload the spring. Since a motor is usually too complex, such closing systems are dependent on the handle for opening the door. In the case of dishwashers, in particular, the manufacturers are encouraged, due to regulations, to provide for automatic opening of the door after the washing process, in order to support the drying process. This automatic opening can also be utilized in handle-free doors.

The problem addressed by the present disclosure is therefore that of providing a possibility for actuating a door lock or a door lock for domestic appliances, in particular for dishwashers, wherein the closing mechanism is functionally designed in such a way that it can be unlocked (opened) manually as well as automatically and a correspondingly designed door lock can be utilized, in an easily adaptable manner, in the case of doors with or without a handle.

This problem is solved according to the present disclosure by a method for actuating a door lock having the features described herein.

SUMMARY

Therein, in the open position, the spring element is released with respect to the closing force to be applied and, in order to lock the door, the locking bar, proceeding from the open position, is brought into the locked position under tension of the spring element. In this position, a closing force, which is determined by the spring element, acts on the locking bar. In order to unlock the door, the locking bar is brought out of the locked position into an unlocked position with the aid of an actuating force that is not applied by the spring element, and, after the striker has moved out of the locked position, the locking bar is moved into the open position by means of the force of the spring element. During the unlocking of the door, the applied actuating force can be applied manually with the aid of muscular force, for example by pulling on the door, or mechanically with the aid of an operative element. The locked positions that are assumed can deviate from each other depending on the type of the actuation during the opening. The movement of the locking bar out of the locked position into the open position can be implemented by way of a single movement or by way of several movements, depending on the type of the actuation.

According to one embodiment of the method, in order to lock the door and, therefore, in order to move the locking bar out of the open position, an actuator of the lock mechanism located at the locked position of the striker presses against the striker, and therefore the striker moves into the locked position by the actuator moving away, i.e., being pushed away. During this action, the spring element is initially tensioned via the actuator by means of the striker and, thus, the locking bar moves out of the open position into an intermediate position and, subsequently, the spring element partially releases and, thus, the locking bar moves out of the intermediate position into the locked position while a remaining residual tension of the spring element forming the closing force is maintained. By virtue of the embodiment or the arrangement of the door lock housing described at the outset, the door is moved during closing, and therefore the striker moves into the door lock housing due to the movement of the door lock housing. The locking bar therefore moves out of the open position first into an intermediate position, in which the locking bar has not yet engaged with the striker, and subsequently out of the intermediate position into the locked position. The spring element, which is released at the beginning with respect to the closing force, is fully tensioned in the intermediate position and is partially tensioned in the locked position and therefore maintains an adjustable closing force, with the aid of which the locking bar, in the latch of the striker, presses onto the striker.

In order to manually unlock by hand by pulling on the door, the locking bar is moved out of the locked position into a first unlocked position by means of a relative movement of the striker with respect to the locking bar counter to the closing force of the spring element. In order to automatically unlock, the locking bar is advantageously moved into a second unlocked position, wherein the actuating force is applied by an electrical operative element. The unlocked positions in the different types of opening are therefore different. As described above, the locking bar is moved back into the open position by means of the spring force of the spring element, independently of which unlocked position the locking bar is in.

According to yet another embodiment of the method, the actuator is moved back into its start position while the striker is leaving the locked position or after the striker has left the locked position. This movement can be effectuated by assisting the spring element via the lever element and by assisting the inherent force of the actuator, or simply by means of the inherent force of the actuator.

The door lock according to the disclosure is distinguished by the fact that, in the open position, in which the door is unlocked, the spring element is released with respect to a closing force to be applied and the lever element holds the locking bar in a striker region which is occupied by the striker in the locked position. The locking bar is therefore located substantially in a region which it also occupies in the locked position, in which the locking bar is disposed in the latch in the striker. In order to move into the locked position, the locking bar must therefore first be moved out of this striker region. The spring element itself can also be preloaded in the open position, although this preload only has an effect on the operative forces of the spring element to be adjusted, per se, and does not have an effect on actuation in conjunction with the locking.

This advantageously takes place, according to the disclosure, by means of an actuator, which comprises an actuating element and a rotational element, which is mounted in the door lock housing and is rotatable about an axle, and upon which the striker acts during the locking process. In the open position, the actuating element lies in a recess in the door lock housing and extends into the striker region. In the locked position, the actuating element lies in a curved guide region—which abuts the striker region—of the recess in the door lock housing. The guide region serves to deflect the actuating element in the door lock housing by approximately 180°. The actuating element acting tangentially on the rotational element during locking can be designed, for example, as an elastic spring hinge, which is tensioned by way of the guidance of the recess over the curved guide region. At a later point in time, when the locking bar moves back into the open position, the spring element can release and, as a result, can return to the open position, and therefore the rotational element interacting with the actuating element also returns to its start position. The same can also be implemented by means of a roller hinge consisting of a large number of parallel cylindrical rollers, wherein a torsion spring is to be disposed on the rotational element in this case, the torsion spring effectuating the return movement of the actuator, i.e., of the rotational element and of the actuating element, back into the start position, in the open position. The rollers and the spring hinge can be made of plastic or metal. Advantageously, the magnetic embodiment may consist of metallic rollers. The actuating element extends into a region of the recess, into the striker region, which is occupied by the striker in the locked position thereof. During the relative movement between the door lock housing and the striker, the striker presses against the actuating element and pushes the actuating element into the curved recess in the door lock housing. As a result, the rotational element of the actuator rotates about the axle mounted in the door lock housing.

According to one embodiment of the invention, the rotational element of the actuator and the lever element comprise teeth, which are disposed at the circumference and can be brought into and out of engagement with each other. During the movement of the striker into the locked position, the teeth of the rotational element of the actuator and the teeth of the lever element enter into engagement during the initial movement of the actuator. The number of teeth depends on the distance that the lever element must be moved. Usually there are one to three teeth, which are to be provided on the actuator as well as on the rotational element. Due to the interlocking, the actuator, which is mounted so as to be rotatable about the axle thereof, rotates the lever element about the axle thereof, which differs from the axle of the actuator. The lever element thus tensions the spring element, which is preferably designed in the form of a coil spring, to which pressure can be applied in the axial direction. During this rotation of the lever element, the locking bar moves out of the position that it had occupied in the open position of the lock. Once an intermediate position has been reached, the teeth disengage, and therefore the actuator can no longer apply force, via the teeth thereof, onto the lever element. Consequently, the spring element releases and moves the lever element back again, and therefore the locking bar comes to rest via the contact surface thereof in the latch of the striker. Since the spring cannot completely release, because the locking bar is already resting against the striker, a residual tension exists, which forms the closing force, with the aid of which the locking bar holds the striker in the locked position of the striker. This closing force can be adjusted by means of an appropriate embodiment and dimensioning.

According to yet another embodiment, the lever element is rotatably mounted in a tilting bearing mounted on an axle of the rotational element in the door lock housing. As a result, due to the rotation of the lever element effectuated by the rotational element, the lever element can be advantageously additionally rotated about the axle of the rotational element by means of the striker pressing on the locking bar in order to move the locking bar out of the open position into the intermediate position. In this case, the locking bar is therefore not moved out of the open position into the intermediate position solely by means of the teeth, but rather first by means of the indirect action of the striker via the actuator having the interlocking teeth and, finally, directly by means of the striker. This embodiment also makes it possible for the locking bar to be opened by way of the lever element moving about the axle of the rotational element by the action of force by the striker. This embodiment advantageously also makes automatic opening possible, advantageously by means of an electromagnetic operative element, which engages at the axle of the lever element. Due to this movement, the teeth of the rotational element of the actuator and the teeth of the lever element also become disengaged, and therefore the actuator can move back into the start position thereof, into the open position, in the manner described above.

The opening of the door can take place either manually or automatically, as mentioned above. During manual opening by way of pulling on the door by hand, the lever element is rotated at least partially about the axle thereof, preferably via the locking bar by means of a relative movement of the striker with respect to the locking bar counter to the closing force of the spring element, until either the locking bar has moved out of the latch of the striker due solely to the rotational motion or due to a force applied by the striker onto the tilting mounting. As a result, the actuating element can release and extend in the direction of the striker, wherein, as described above, either a spring hinge releases or a torsion spring moving a roller hinge releases.

During automatic opening, an electromagnetic operative element, preferably a solenoid, engages at the axle of the lever element, and therefore the lever element for opening the locking bar can be moved out of the position thereof during locking, due to the tilting mounting, by the action of force. The unlocked position occupied by the locking bar deviates from the unlocked position during the manual opening.

According to yet another embodiment, the spring element, in the absence of a counteracting force, independently of the manner in which the opening of the door lock has taken place and independently of the unlocked position in which the locking bar is, moves back into the open position and, thus, releases, and therefore the start position is reached by all participating elements of the door lock in the open position with the spring element released. To this end, the lever element rotates back into the position thereof in the open position, wherein the axle of the lever element is also brought back into the start position by means of the tilting mounting. Microswitches can be disposed in the door lock housing, in order to transmit the particular position of the locking bar to a machine control. In this way, for example, a microswitch can signal the open position and, if necessary, the closed position by means of an appropriate electrical signal to the machine control. In the case of a handle-free door, it can be detected, for example, by means of a sensor that is usually provided for this purpose, when the user is pressing against the door and, therefore, the position of the locking bar or the door as a whole is changing slightly. This change triggers a corresponding signal in the machine control, and therefore the solenoid is actuated and the locking bar is moved out of the latch of the striker. The embodiment also makes it possible to actuate the solenoid and unlock the door lock, by means of the machine control, at a certain point in time, for example in order to assist the drying process (EcoDry). The opening of the door then usually takes place by means of the weight of the door, wherein assistance can additionally be given by means of the releasing actuator, which is pressing against the striker. Opening elements, such as, for example, compression springs, which are installed directly into the door hinges, are also provided for this purpose. By virtue of the embodiment of the door lock according to the invention and by virtue of the arrangement of the spring element in combination with the lever element having a transmission ratio, there is a relatively long displacement of the moving end of the spring element, and therefore this can be advantageously used to detect the locking-bar position and, in the case of a handle-free door, the desire of the operator to open. As mentioned above, the user then presses once or, to be certain, twice against the closed door and therefore triggers the automatic opening. To this end, a sensor body connected to the end of the spring element can be provided, which, during the movement of the end of the spring element, is guided over at least one coil located in a circuit board, in order to generate a measurement signal.

By virtue of this method according to the disclosure and the door lock according to the disclosure, it is therefore possible to implement the opening by hand as well as automatically with one door lock, wherein the lock mechanism can remain unchanged and adaptation can be made simply by means of one additional operative element, for example in the form of a solenoid. This design can be adapted to the device-related specifications, and therefore this locking and unlocking principle can be implemented with all domestic appliances, in particular dishwashers. This saves additional motors for opening and is an advantageous alternative to existing door locks for such domestic appliances.

The method and door lock are described in greater detail in the following with reference to exemplary embodiments shown in the drawings. Further features will become apparent from the description of the exemplary embodiments of the disclosure that follows, in combination with the claims and the attached figures. The individual features of the disclosure can be implemented alone or in combination in different embodiments of the disclosure.

DETAILED DESCRIPTION

Figure 1:
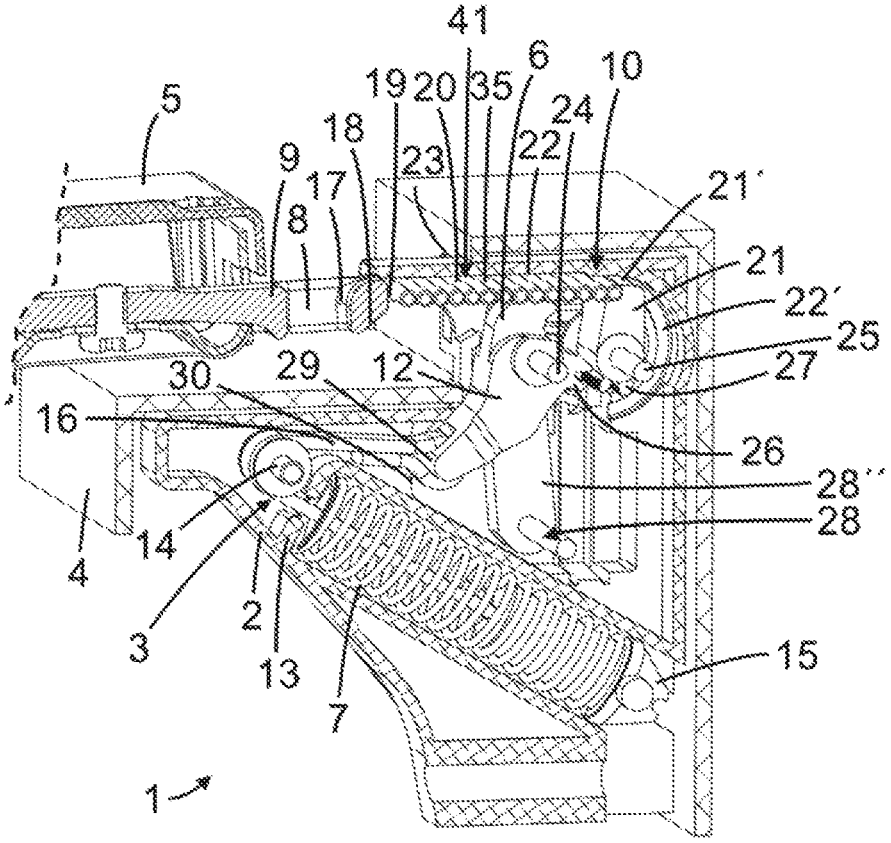
FIG. 1 shows a partial cross section through a door lock according to the invention in the open position.

FIG. 1 shows the open position of the door lock 1 having a door lock housing 2, which is disposed in a door 4 of an electrical domestic appliance, in particular a dishwasher. A striker 9 extends out of the housing of a domestic device 5, in order to be brought into engagement, through an opening 23, with the lock mechanism 3 disposed in the door lock housing 2. The striker 9 comprises a latch 8 for the engagement of a locking bar 6 disposed in the door lock housing 2. The tip of the striker 9 comprises a closing surface 17 on the latch side and an impact surface 19 on the free end of the striker 9. A pressure surface 18 extending at an angle is located on the underside of the striker 9. Located in the lock housing 2 is a lever element 12, which is mounted so as to be rotatable about an axle 24 and on which the locking bar 6 is disposed. A spring cable 16 engages at the end of the lever element 12 opposite the locking bar 6 and is connected via a deflection element 14 to a spring holder 15, which presses a spring element 7 against an abutment 13. The spring element 7 is designed as a compression spring, which is under an adjustable preload in the open position, in order to adapt the spring characteristics and spring forces for the function of the lock mechanism 3. The slanted arrangement of the spring element 7 in this exemplary embodiment results from the predefined installation space in the door 4. Basically, another arrangement of the spring element 7 with or without deflection is possible, provided appropriate installation space is available. An actuating element 20, which consists of parallel rollers 35, which can also be magnetic, is also located in the door lock housing 2, along the extension of the striker 9. The actuating element 20 bears, via the end thereof facing away from the striker 9, against a rotational element 21 and, together therewith, forms an actuator 10. The rollers 35 are guided at the ends thereof in a recess 22 and extend laterally over the rotational element 21, which protrudes via one end 21' thereof into the curved region 22' of the recess 22. The curved region 22' of the recess 22 permits deflection of the actuating element 20 by 180°. Located on the side of the rotational element 21 opposite the end 21' are two teeth 27, which enter into engagement with teeth 26 on the lever element 12 during a rotation of the rotational element 21 about the axle 25 mounted in the door lock housing 2. In the open position of the door lock 1 depicted in this figure, the spring element 7 is in a released position with respect to the closing process, the locking bar 6 and the actuating element 20 are located in a striker region 41, which is occupied by the striker 9 in the locked position thereof.

Figure 2:
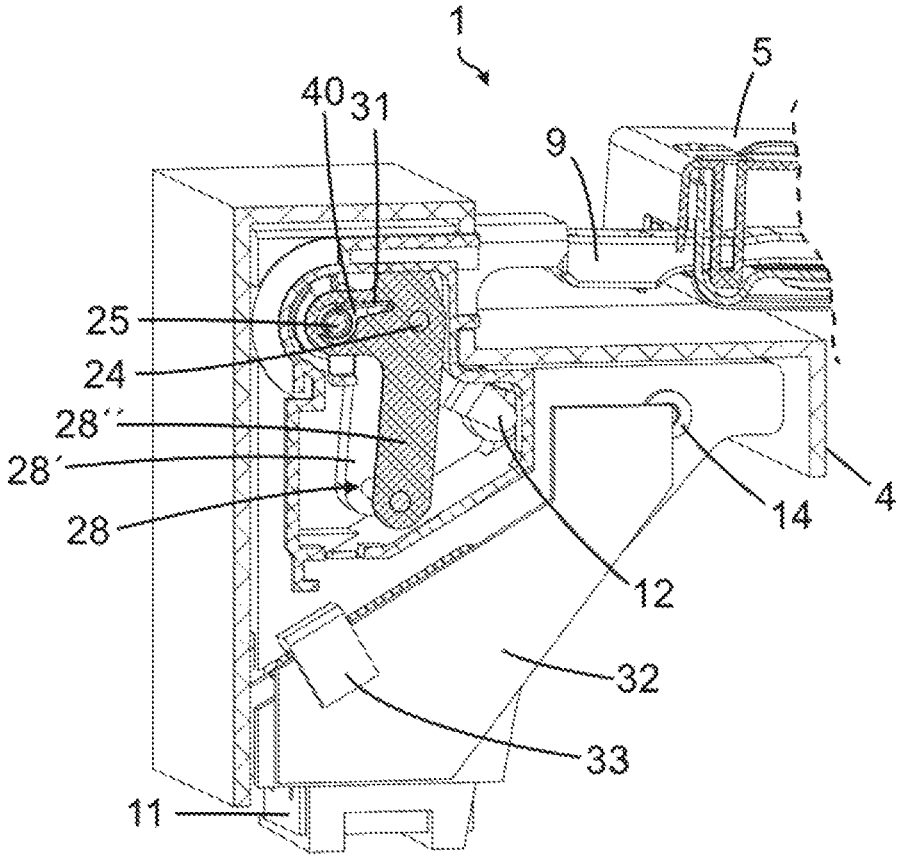
FIG. 2 shows a partial cross section of the door lock from the opposite side of FIG. 1.

FIG. 2 correspondingly shows the opposite side of the door lock 1. Shown therein, in a partially cutaway view, is the tilting element 28, which is also shown in FIG. 1 from the other side, which has two tilting element arms 28', 28" and is rotatable about the axle 25 of the rotational element 21 mounted in the door lock housing 2. The lever element 12 is mounted, via the axle 24 thereof, between the tilting element arms 28', 28". A torsion spring 31 is disposed around the axle 25 and engages via one arm into the rotational element 21 and rotates therewith, while the other arm of the torsion spring 31 lies in a recess 40 in the tilting element arms 28', 28" of the tilting element 28 and bears against the tilting element arms 28', 28". Due to the cutting plane, the recess 40 appears to be an opening in this depiction. A circuit board 32 including the associated control electronics is disposed outside of the door lock housing 2, but is connected thereto. The control electronics contains coils, which are disposed in the circuit board 32 and are also not illustrated, and over which a sensor body 33 can be moved. The sensor body 33 can also be disposed on only one side of the circuit board 32. The sensor body is rigidly connected to the spring holder 15 and therefore moves along therewith. Due to the movement of the sensor body 33 along the non-illustrated coils, measurement signals can be generated in a known manner, which are used to detect the current position of the locking bar 6. These are essentially the open position and the locked position. By virtue of the embodiment of the lever element 12, given only a slight movement of the locking bar 6, the spring holder 15 is moved approximately 2.5-fold as far, due to the leverage, and therefore, due to this movement, a measurement signal is generated, which can be used to automatically open the door lock 1. In the case of a handle-free door 4, by way of a predefined number of pressing movements against the door 4, this slight movement of the locking bar 6 can be detected by way of compression of a door seal and, as a result, the opening process can be triggered.

Figure 3:
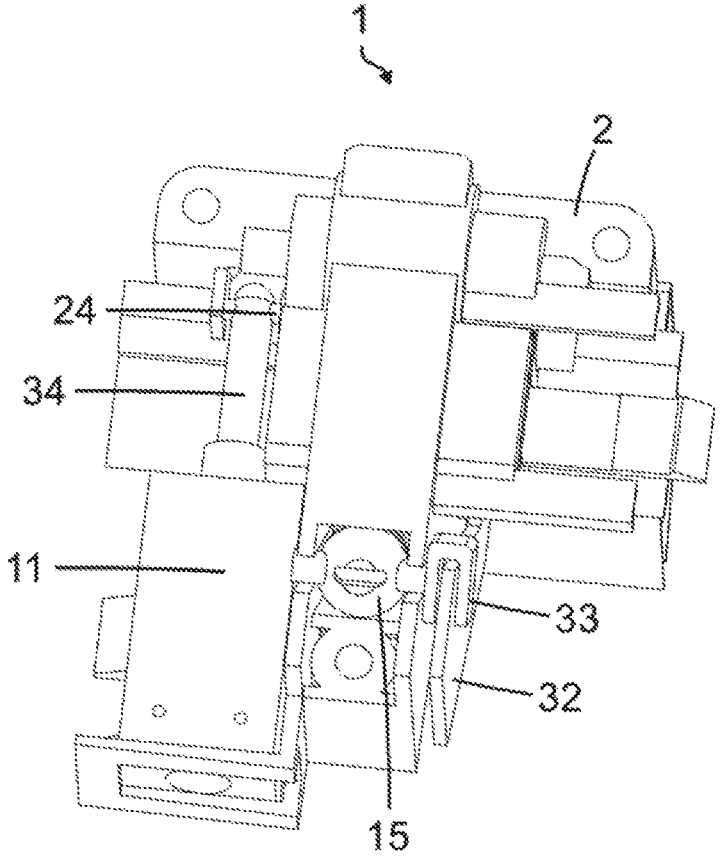
FIG. 3 shows the door lock housing from the door side (user side), from the underside at an angle.

The view according to FIG. 3 shows the door lock housing 2 including a solenoid 11, which is disposed outside of the door lock housing 2 and includes an armature 34, which engages at the axle 24 extending out of the door lock housing 2. The solenoid 11, as is likewise the case with the circuit board 32, is connected to the door lock housing 2. The figure also illustrates the rigid, one-piece embodiment of the spring holder 15 having the sensor body 33.

Figure 4:
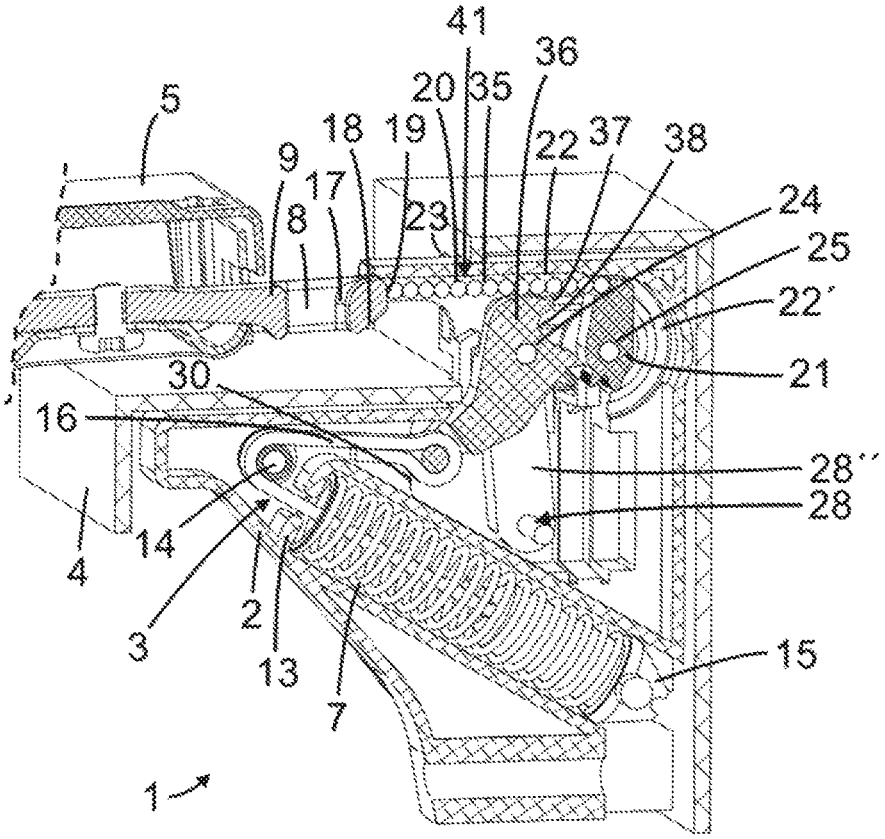
FIG. 4 shows the view according to FIG. 1 with a partial cross section in a cutting plane lying deeper in the door lock housing.

The closing process is described in the following with reference to FIGS. 4 to 9 that follow. The directions of rotation of the rotational element 21 and of the lever element 12 are indicated by arrows in the figures. FIG. 4 shows the open position, once more, according to FIG. 1, wherein, in this figure and in the following, the cutting plane has been placed deeper, in parts, into the door lock housing 2 for the purpose of illustration, and therefore the actuator 10 and the lever element 12, in particular, are shown partially in cross section, in order to better illustrate the mode of operation.

Figure 5:
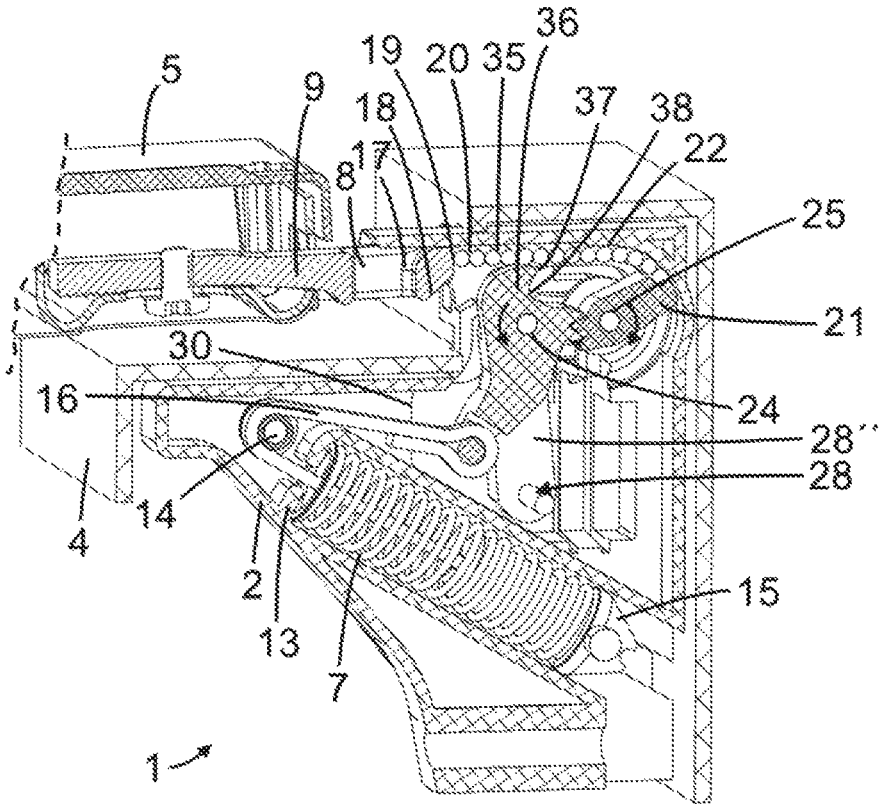
FIG. 5 shows a partial sectional view according to FIG. 4 during the closing process.

In FIG. 5, the door 4 has already moved somewhat toward the domestic appliance 5, and therefore the striker 9, with the impact surface 19 thereof pressing against the first roller of the actuating element 20, has moved the actuating element 20, which is similar to a flexible roller hinge, in the recess 22, along the longitudinal axis thereof. The actuating element 20 presses via the other end thereof against the rotational element 21, which thus enters into engagement via the teeth 27 thereof with the teeth 26 of the lever element 12. As a result, the lever element 12 is rotated about the axle 24 thereof in the arrow direction, and therefore the locking bar 6 moves out of the open position. As a result of this rotational motion, the spring element 7 is tensioned by the lever element 12 via the spring cable 16.

Figure 6:
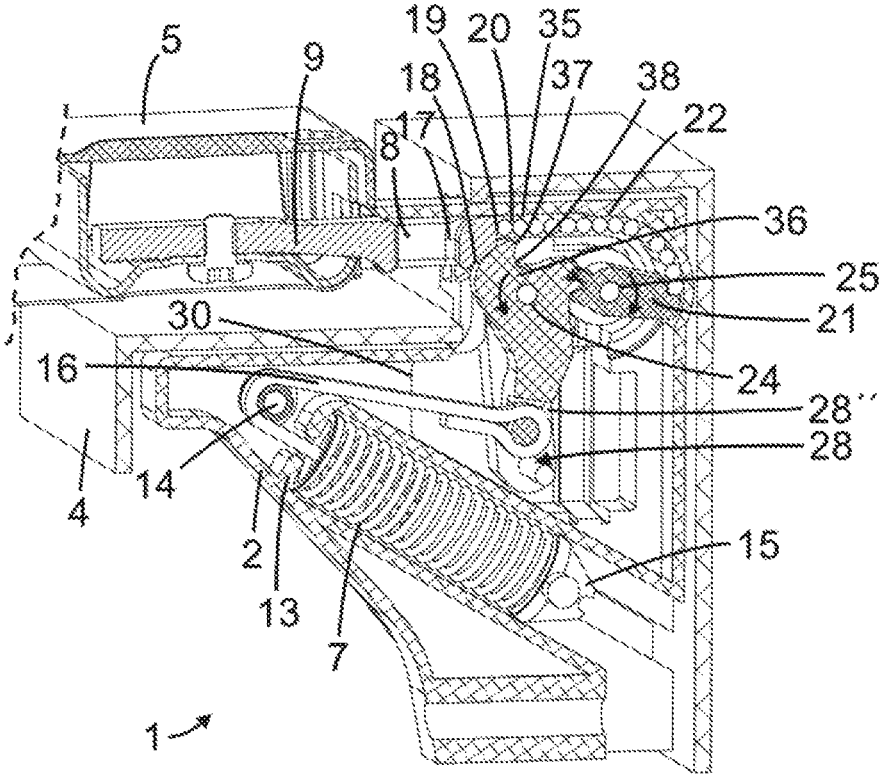
FIG. 6 shows a partial sectional view according to FIG. 4 during the closing process at a later point in time.

The rotation operation has progressed further in FIG. 6. The rotational element 21 and the lever element 12 have rotated further, thereby tensioning the spring element 7 even further. The striker 9 has come into contact, via the slanted pressure surface 18, with the mating surface 36 of the locking bar 6, and therefore, upon a further movement of the striker 9, the lever element 12 moves via the axle 24 thereof about the axle 25 and, therefore, downward at an angle in the figure, due to the mounting of the lever element 12 in the tilting element 28.

Figure 7:
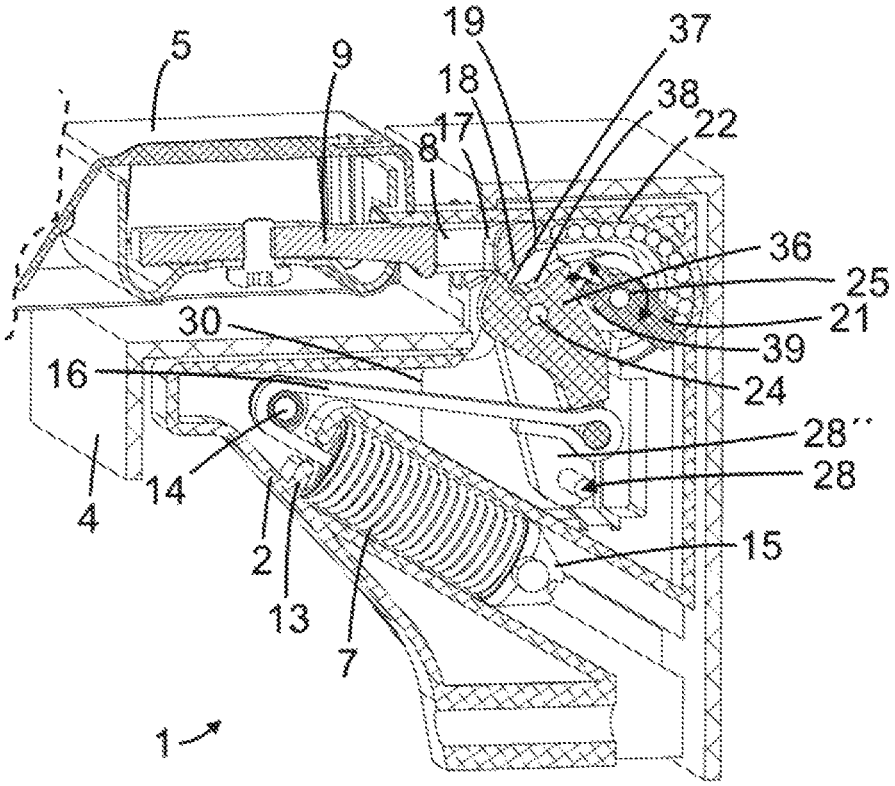
FIG. 7 shows a partial sectional view according to FIG. 4 during the closing process with the locking bar in an intermediate position.

The result of this movement is depicted in FIG. 7, in which the striker 9 has penetrated further into the straight region of the recess 22 provided for the striker. Due to the forward movement, the rotational element 21 of the actuator 10 has also rotated further and, thus, has carried the lever element 12 slightly further along and has then become disengaged from the lever element 12 due to the movement of the lever element 12 caused directly by the pressure surface 18 of the striker 9. FIG. 7 shows the intermediate position, in which the locking bar 6 has completely cleared the path for the striker 9. The spring element 7 is maximally tensioned. The rotational element 21 now lacks counterforce, and therefore, due to the force of the spring element 7, as soon as the latch 8 for the locking bar tip 37 is exposed by way of the further movement of the striker 9, the spring element 7 releases and the lever element 12, with the locking bar 6, rotates back about the axle 24. The position of the tilting element arm 28" of the tilting element 28, which has changed as compared to FIG. 6, is also clearly apparent in the figure.

Figure 8:
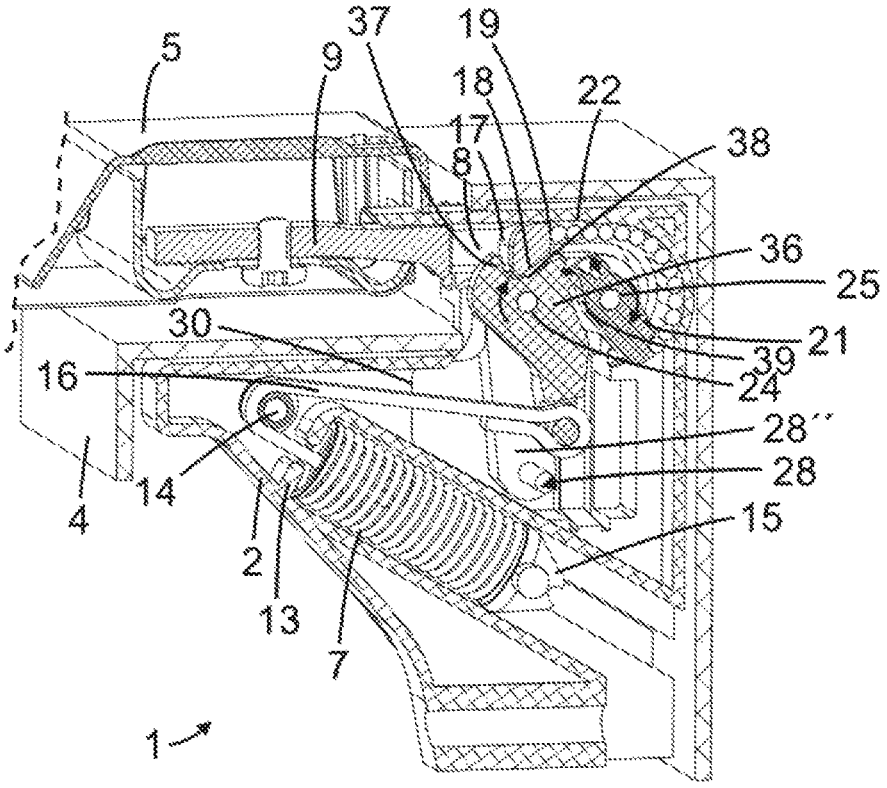
FIG. 8 shows a partial sectional view according to FIG. 4 during the closing process, wherein the locking bar is moving out of the intermediate position into the latch of the striker.

In FIG. 8, the striker 9 has moved further into the recess 22 and is located, via the front end thereof, in the locking bar depression 38. As a result, the rotational element 21 has also rotated further in the arrow direction, without being impeded by the lever element 12, due to the free surface 39. The lever element 12 has rotated back in the arrow direction, and therefore the locking bar 6 has already moved, via the locking bar tip 37 thereof, slightly into the latch 8. As is also shown in the figure, the tilting element 28 has also moved back as compared to the position in FIG. 7, and therefore the axle 24 of the lever element 12 has also moved upward. The spring element 7 has already released slightly.

Figure 9:
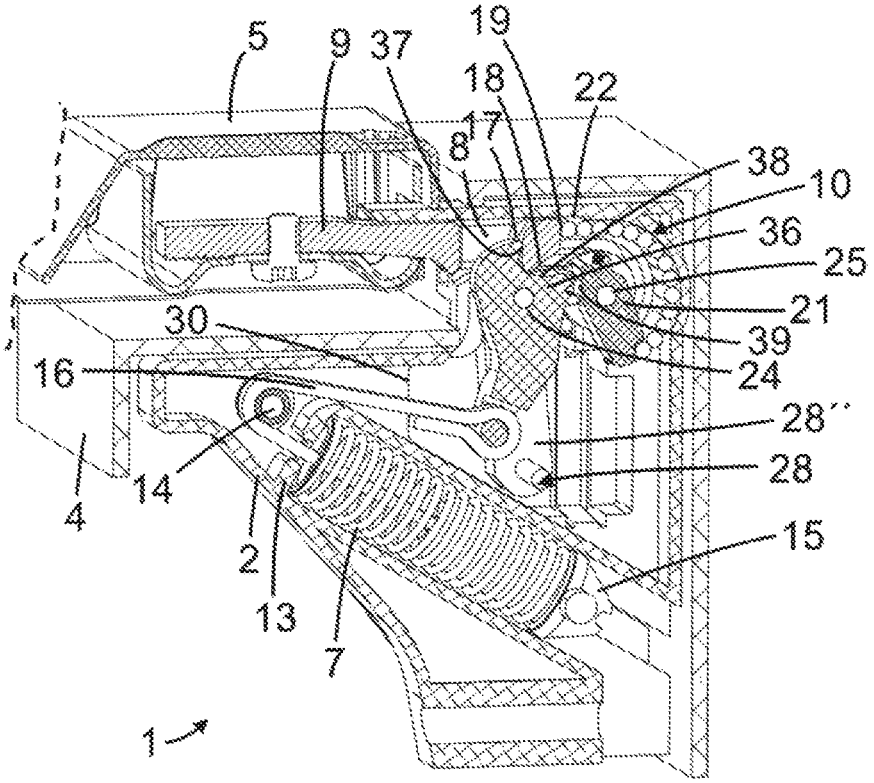
FIG. 9 shows a partial sectional view according to FIG. 4 with the locking bar and the striker in the locked position.

In FIG. 9, the striker 9 is in the locked position thereof and the locking bar 6 is in the closed position. The door 4 is located against the stop predefined by the non-illustrated door seal. The actuator 10 has moved further and the rotational movement of the rotational element 21 has been completed. The locking bar 6 presses via the locking bar tip 37 thereof, which comprises a contact surface, against the closing surface 17 of the striker 9 and is held in this position by the force of the spring element 7. The closing force of the locking bar 6 can be adjusted by an appropriate dimensioning of the spring element 7. The locking bar 6 has assumed the locked position thereof and holds the door 4 closed. The spring force is in equilibrium with the door seal force via the spring cable 16, the lever element 12 comprising the locking bar 6, and the striker 9.

Figure 10:
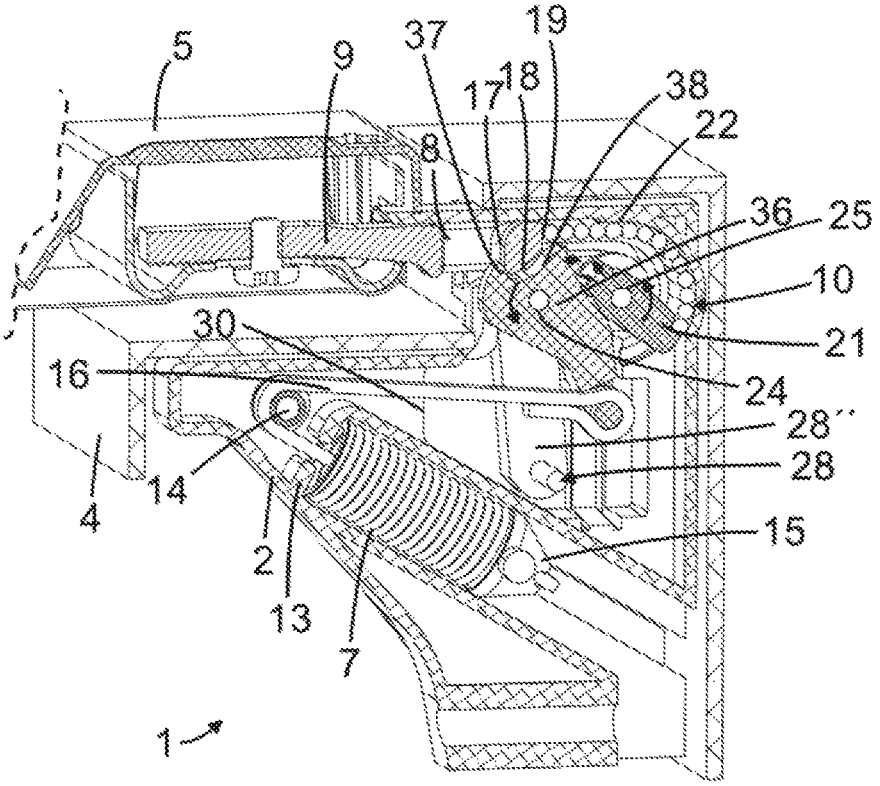
FIG. 10 shows a partial sectional view according to FIG. 4 during manual opening, wherein the striker has already largely rotated the locking bar out of the latch.
Figure 11:
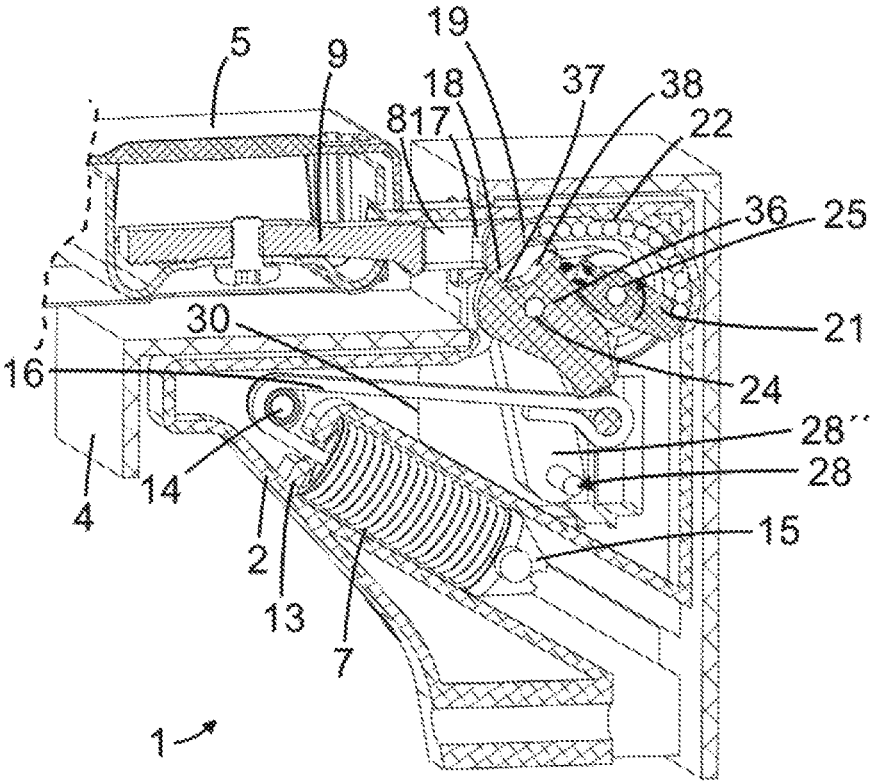
FIG. 11 shows a partial sectional view according to FIG. 4 during manual opening, wherein the locking bar is in the unlocked position.
Figure 12:
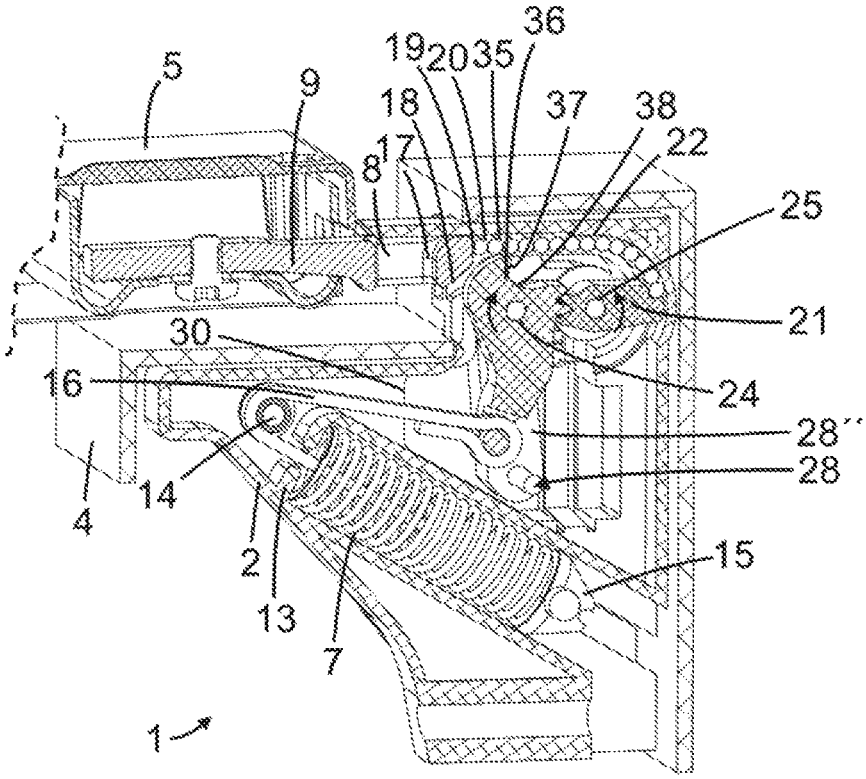
FIG. 12 shows a partial sectional view according to FIG. 4 during manual opening, wherein the locking bar is on the way into the open position.

The manual opening by hand by means of pulling in a non-illustrated handle on the door 4 is depicted in FIGS. 10 to 12 and is described with reference thereto. Due to the pulling on the door 4, the striker 9 has already left the locked position thereof, in FIG. 10, and has moved back slightly. The closing surface 17 presses against the locking bar tip 37 and, thus, rotates the lever element 12 about the axle 24 thereof counter to the force of the spring element 7, in the arrow direction. Due to the absence of a counterforce by the striker 9, the torsion spring 31 depicted in FIG. 2 has actuated the actuator 10 and, engaging at the rotational element 21, has rotated the rotational element about the axle 25 thereof in the arrow direction, and thus, has also moved the actuating element 20 along in the direction of the striker 9.

In FIG. 11, the locking bar 6 is in the unlocked position thereof. The locking bar tip 37 is completely out of the latch 8 of the striker 9, wherein, triggered by the pressure of the striker 9 on the locking bar tip 37 of the locking bar 6, the axle 24 of the lever element 12 has also moved slightly about the axle 25 of the rotational element 21 due to the tilting mounting of the lever element 12. The spring element 7 is not tensioned to a greater extent as compared to the position in FIG. 6.

Once the locking bar 6 has reached the unlocked position, reversal of the rotational direction of the locking bar 6 with the lever element 12 takes place, while the rotational element 21 continues to rotate in the same direction. This is depicted in FIG. 12, wherein the depiction in FIG. 12 is similar to the depiction in FIG. 6, with the difference, however, that the rotational directions of the lever element 12 as well as of the rotational element 21 are reversed. The striker 9 has moved further back out of the recess 22 and the actuating element 20 has occupied the exposed space due to the force of the torsion spring 31 acting on the rotational element 21. The rotational motion of the lever element 12 is effectuated by the release of the spring element 7. Due to the force component of the spring cable 16, not only does the lever element 12 rotate about the axle 24 thereof, but the tilting element 28 also moves back and, therefore, the axle 24 is displaced upwardly in the figure. During these movements, the teeth 26 and 27 enter into engagement again.

Figure 13:
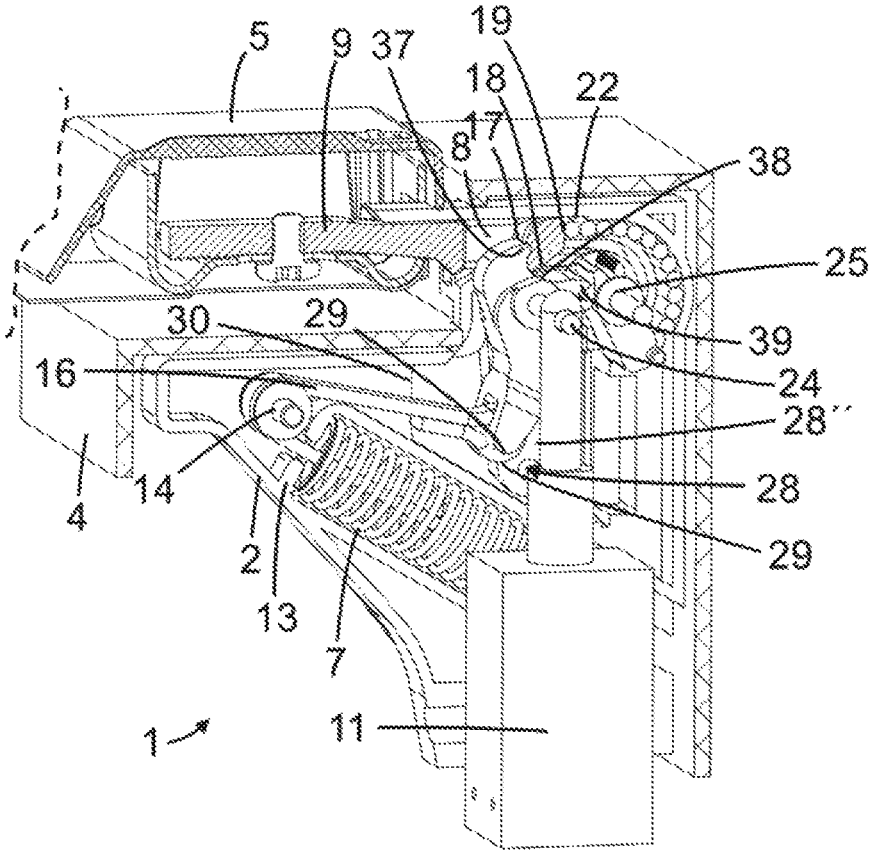
FIG. 13 shows a partial sectional view according to FIG. 1 with the locking bar in the locked position according to FIG. 9 with an additional solenoid, which is located outside of the door lock housing.

In FIGS. 13 to 16, the automatic opening is depicted by means of an operative element in the form of the solenoid 11 with the armature 34 thereof engaging on the axle 24 of the lever element 12. FIG. 13 shows the locked position, once more, according to FIG. 9, wherein, in this case, the rotational element 21 and the lever element 12 are not depicted in sectional views and the solenoid 11, which is disposed outside of the door lock housing 2, is additionally shown. When a solenoid 11 is utilized, the armature 34 moves along with the closing movements of the lever element 12. The solenoid is first activated when, as described above, the user presses against the door 4, thereby compressing the seal to a slightly greater extent, and generates a signal that triggers the actuation of the solenoid 11, or the machine control triggers drying assistance.

Figure 14:
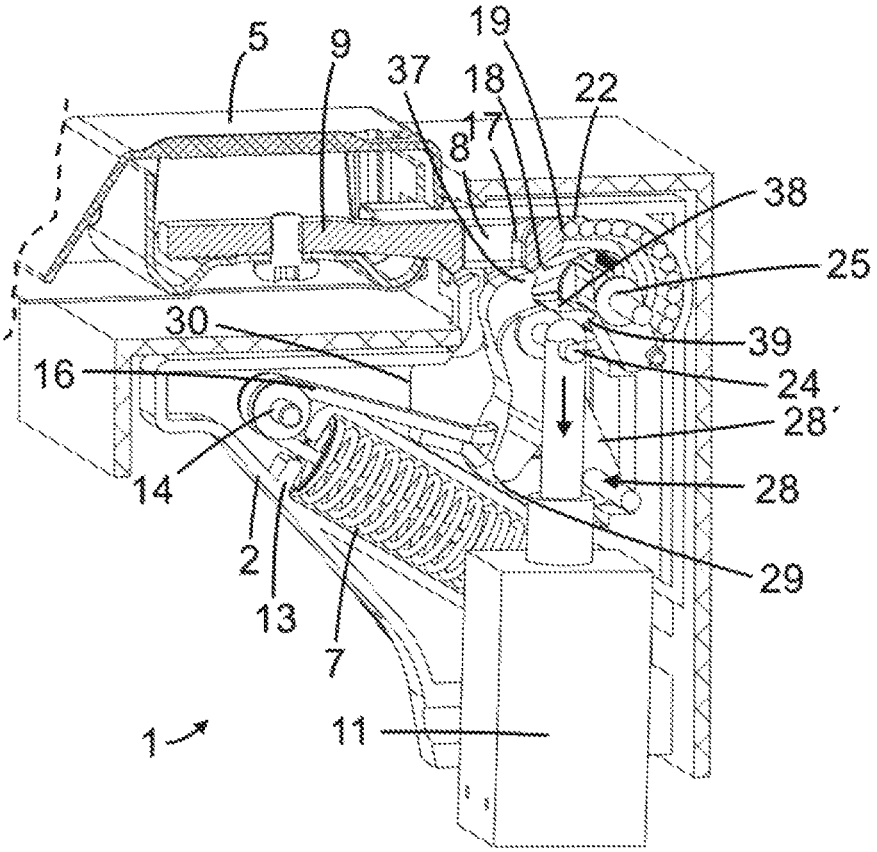
FIG. 14 shows a partial sectional view according to FIG. 13, wherein the solenoid has moved the locking bar into the unlocked position.

In FIG. 14, the armature 34 has moved in the arrow direction and, as a result, has moved the locking bar 6 out of the latch 8 with force. This takes place via the tilting mounting of the lever element 12, and therefore the axle 24 carries out a motion that is downward in the figure, about the axle 25. As a result, the striker 9 can be pushed back via the force of the torsion spring 31. The lever element 12 can also rotate back about the axle 24 thereof, due to the force of the spring element 7, without coming into conflict with the rotational element 21, since the teeth 26 and 27 can rotate past each other.

Figure 15:
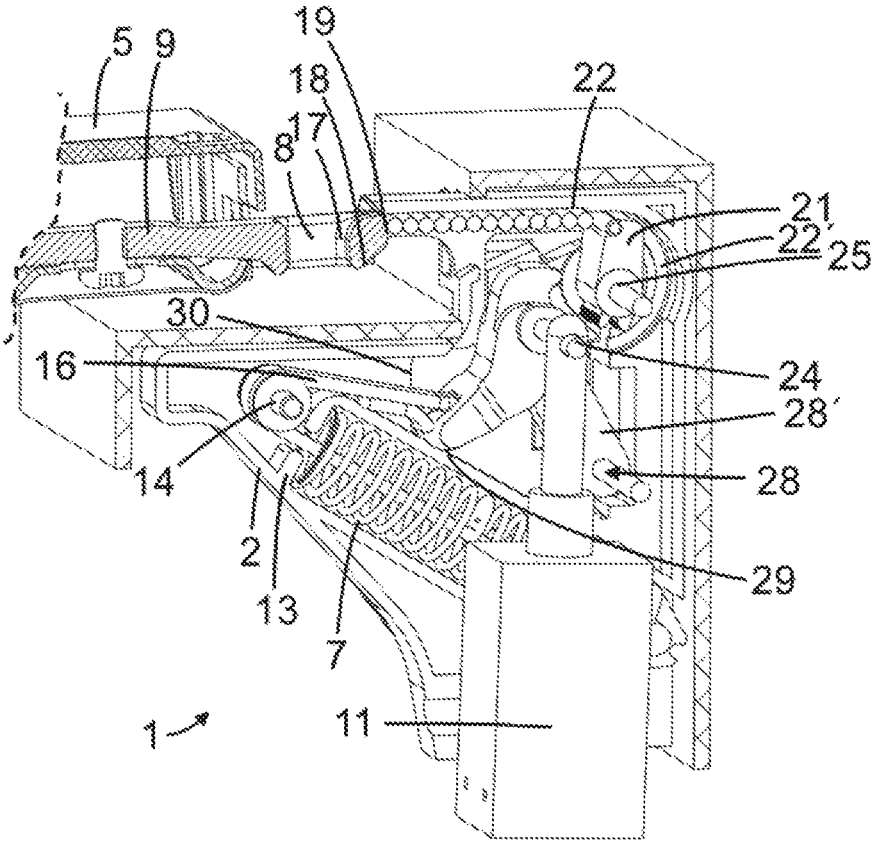
FIG. 15 shows a partial sectional view according to FIG. 13, wherein the striker is already in the open position and the locking bar has been rotated into the unlocked position by the spring element.

The result of these movements is depicted in FIG. 15. The rotational element 21 has pressed the striker 9, via the actuating element 20, into the open position and is in the start position again, in the striker region 41 of the recess 22 according to FIG. 1. The lever element 12 has already been rotated completely about the axle 24 due to the spring force of the spring element 7, but the axle 24 is not yet in the original open position, due to the tilting mounting. This is achieved by the front edge 29 of the lever element 12 impacting stop edges 30 disposed in the door lock housing 2, on both sides, and therefore a further rotational movement is not possible and the free force component, which is directed upward in the figure, of the spring cable 16 moves the lever element 12 upward into the start position depicted in FIG. 1, in the open position.

Figure 16:
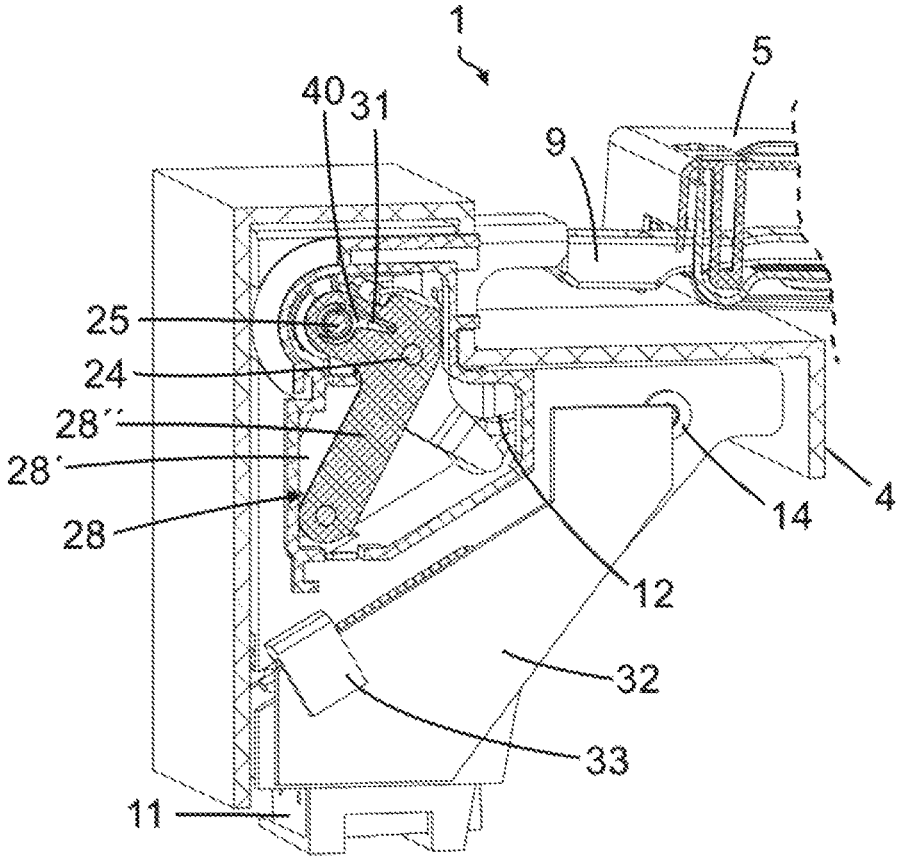
FIG. 16 shows a partial sectional view according to FIG. 2 from the opposite side, wherein the striker and the locking bar are in the position according to FIG. 15.

Finally, FIG. 16 shows the position of the striker 9, the lever element 12, and the tilting element 22 in the same position as in FIG. 15, from the opposite side.

LIST OF REFERENCE CHARACTERS

1 door lock
2 door lock housing
3 lock mechanism
4 door
5 domestic appliance
6 locking bar
7 spring element
8 latch
9 striker
10 actuator
11 solenoid
12 lever element
13 abutment
14 deflection element
15 spring holder
16 spring cable
17 closing surface
18 pressure surface
19 impact surface
20 actuating element
21 rotational element, 21' end
22 recess, 22' curved region
23 opening
24 rotational axle of lever element
25 rotational axle of rotational element
26 teeth of lever element
27 teeth of rotational element
28 tilting element, 28'/28" tilting element arm
29 front edge of lever element
30 stop edge
31 torsion spring
32 circuit board
33 sensor body
34 armature
35 rollers
36 mating surface
37 locking bar tip
38 locking bar depression
39 free surface
40 recess in 28
41 striker region

The invention claimed is:

1. A method for actuating a door lock comprising a lock mechanism in a door lock housing for a door of an electrical domestic appliance, wherein, for locking, a locking bar is moved from an open position into a locked position by way of a spring element acting on the locking bar via an attachment that is configured to transmit force between the spring element and the locking bar, wherein, in the open position, the door is opened and the locking bar is disengaged from a latch of a striker disposed on the domestic appliance and, in the locked position, the door is closed, the striker is in a locked position in the door lock housing and the locking bar is engaged with the latch, wherein, to lock the door proceeding from the open position, the locking bar is brought into the locked position under tension of the spring element via the attachment, in which locked position a closing force acting on the locking bar is determined by the spring element, and, to unlock the door, the locking bar is brought out of the locked position into an unlocked position with the aid of an actuating force that is not applied by the spring element, and, after the striker has moved out of the locked position, the locking bar is moved into the open position by the force of the spring element via the attachment; and wherein, to lock the door and, therefore, to move the locking bar out of the open position, an actuator of the lock mechanism located at the locked position of the striker presses against the striker and the striker moves into the locked position by the actuator moving away, wherein, simultaneously, the spring element is initially tensioned via the actuator by way of the striker and, thus, the locking bar moves out of the open position into an intermediate position and, subsequently, the spring element partially releases and, thus, the locking bar is moved out of the intermediate position into the locked position while a remaining residual tension of the spring element forming the closing force is maintained; and wherein the actuator, which comprises a flexible actuating element and a rotational element, which is mounted in the door lock housing and is rotatable about an axle, the actuator being situated in a recess in the door lock housing, in the open position, and, thus, extends into the striker region and, in the locked position, lies in a curved guide region of the recess in the door lock housing abutting the striker region.

2. The method according to claim 1, wherein, to manually unlock by hand by pulling on the door, the locking bar is moved out of the locked position into a first unlocked position by way of the relative movement of the striker with respect to the locking bar counter to the closing force of the spring element.

3. The method according to claim 1, wherein, to automatically unlock, the locking bar is moved into a second unlocked position by way of an electrical operative element.

4. The method according to claim 2, wherein the actuator is moved back into the start position thereof while the striker is leaving the locked position or after the striker has left the locked position.

5. A door lock for an electrical domestic appliance, comprising a door lock housing, which can be disposed in the door of the domestic appliance and which has an opening for a striker, which can be fastened on the domestic appliance, a locking bar disposed in the door lock housing for engagement into a latch in the striker in a locked position, in which the striker is in a locked position, wherein the locking bar has a contact surface and lever element, which is mounted so as to be rotatable about an axle, and a spring element, which is disposed between the lever element and an abutment, the spring element being configured to act on the locking bar via an attachment that is configured to transmit force between the spring element and the locking bar, wherein, in an open position, in which the door is unlocked, the spring element is released with respect to a closing force to be applied and the lever element holds the locking bar in a striker region which is occupied by the striker in the locked position;

wherein an actuator, which comprises a flexible actuating element and a rotational element, which is mounted in the door lock housing and is rotatable about an axle, the actuator being situated in a recess in the door lock housing, in the open position, and, thus, extends into the striker region and, in the locked position, lies in a curved guide region of the recess in the door lock housing abutting the striker region.

6. The door lock according to claim 5, wherein the rotational element of the actuator and the lever element comprise teeth situated at the circumference, which can be brought into and out of engagement with each other, wherein, during the movement of the striker into the locked position, the teeth of the rotational element and the teeth of the lever element enter into engagement first, and therefore the actuating element rotates the lever element about the axle thereof, which, thus, tensions the spring element and, when an intermediate position is reached, the teeth disengage, and therefore the spring element releases, while maintaining a residual tension, and the lever element rotates back around the axle thereof until the locking bar bears, via the contact surface thereof, in the latch of the striker and presses against the striker with a closing force resulting from the residual tension.

7. The door lock according to claim 5, wherein the lever element is mounted via the axle thereof on the axle of the rotational element via a tilting mounting, the tilting mounting comprising a tilting element rotatably supported about the axis of the rotational element, wherein the axle of the lever element is arranged at the tilting element.

8. The door lock according to claim 7, wherein the striker presses the locking bar out of the striker region via the tilting mounting of the lever element until the intermediate position is reached.

9. The door lock according to claim 5, wherein, to unlock by hand by pulling on the door, the lever element is rotated at least partially about the axle thereof, via the locking bar by way of a relative movement of the striker with respect to the locking bar counter to the closing force of the spring element, until either the locking bar has moved out of the latch of the striker due solely to the rotational motion or due to a force applied by the striker onto the tilting mounting.

10. The door lock according to claim 5, wherein an electromagnetic operative element engages at the axle of the lever element, and therefore the lever element for opening the locking bar can be moved out of the position thereof during locking, due to the tilting mounting, by the action of force.

11. The door lock according to claim 9, wherein the spring element, during release, moves the lever element into the open position, wherein the locking bar is located in the striker region of the recess.

12. An electrical domestic appliance, comprising the door lock of claim 5.

13. The electrical domestic appliance according to claim 12, wherein the electrical domestic appliance is a dishwasher.

14. The door lock according to claim 5, wherein the flexible actuating element is formed as a flexible roller hinge comprising rollers.

15. The door lock according to claim 14, wherein the rollers are guided in a recess that extends over the rotational element.

* * * * *